US006036053A

United States Patent [19]

Simmons et al.

[11] Patent Number: 6,036,053

[45] Date of Patent: Mar. 14, 2000

[54] METHOD AND APPARATUS FOR CONTROLLING A PUMP

[75] Inventors: Darren W. Simmons; Mark E. Bewley, both of San Antonio, Tex.

[73] Assignee: Lancer Partnership, Ltd., San Antonio, Tex.

[21] Appl. No.: 09/112,576

[22] Filed: Jul. 9, 1998

[51] Int. Cl.[7] ..... B67D 5/08

[52] U.S. Cl. ..... 222/1; 222/129.1; 222/64; 222/63; 261/DIG. 7

[58] Field of Search ..... 222/63, 129.1, 222/1, 64, 65, 66; 261/DIG. 7

[56] References Cited

U.S. PATENT DOCUMENTS 4,313,897 2/1982 Garrard ..... 261/DIG. 7
4,882,097 11/1989 Shannon ..... 261/DIG. 7
4,889,662 12/1989 Smith ..... 261/DIG. 7
5,178,799 1/1993 Brown et al. ..... 261/DIG. 7

*Primary Examiner*—Kevin Shaver
*Assistant Examiner*—David Deal
*Attorney, Agent, or Firm*—Christopher L. Makay

[57] ABSTRACT

A pump control apparatus includes a pump coupled at an inlet to a water source and at an outlet to a first dispensing valve and a carbonator via a check valve. A power source is coupled to the pump, and a controller regulates the delivery of power from the power source to the pump. Responsive to a fill signal received from the carbonator, the controller activates the power source to deliver power to the pump at a first predetermined power level. Alternatively, the controller activates the power source to deliver power to the pump at a second predetermined power level in response to a dispense signal received from the first dispensing valve.

8 Claims, 2 Drawing Sheets

METHOD AND APPARATUS FOR CONTROLLING A PUMP

BACKGROUND OF THE INVENTION

1. Field of the Invention

The present invention relates to drink dispensers and, more particularly, but not by way of limitation, to an apparatus and method for controlling a pump.

2. Description of the Related Art

A drink dispenser typically requires plain water for forming carbonated water and for dispensing either alone or with a syrup to produce a non-carbonated drink. As illustrated in FIG. 1, a water delivery system 50 receives plain water from a water source 51, such as a city water line. Unfortunately, such a water source 51 normally delivers plain water at less than 40 psi, which is a pressure below that required by the water delivery system 50. Consequently, the water delivery system 50 includes a water pump 52 that increases the water pressure to approximately 140 psi. The water pump 52 delivers the plain water to dispensing valves 55 and 56 and a carbonator 53 via a valve 54.

The carbonator 53, which is typically pressurized to 75 psi, connects to a carbon dioxide source that delivers carbon dioxide gas therein. The carbon dioxide gas diffuses/dissolves into the water thereby forming carbonated water. The valve 54, which is maintained closed at 75 psi, is a one-way check valve that prevents carbon dioxide gas and/or carbonated water from entering the water source 51.

The carbonator 53 includes a probe for regulating the level of water therein. The probe connects to a relay 57 that facilitates the delivery of power from the power source 58 to the water pump 52. When the probe registers the water level is below a preset level, it outputs a signal that closes the relay 57. The power source 58 delivers power to the water pump 52, which pumps water at approximately 140 psi from the water source 51 into the carbonator 53. When the probe registers the carbonator 53 is full, it deactivates its signal thereby shutting off the water pump 52.

The dispensing valves 55 and 56 also connect to the relay 57. When activated, the dispensing valve 55 and/or 56 outputs a signal that closes the relay 57 so that the power source 58 delivers power to the water pump 52. The water pump 52 pumps plain water to the activated dispensing valve 55 and/or 56, where it is either dispensed directly or mixed with a syrup to formulate a non-carbonated drink. Upon the deactivation of the dispensing valve 55 and/or 56, the relay 57 opens to remove power from the water pump 52.

Although the water delivery system 50 operates adequately to fill the carbonator 53 and supply dispensing valves 55 and 56 with plain water, it suffers a significant disadvantage. When the probe within the carbonator 53 controls the relay 57, the water delivery system functions properly because the dispensing valves 55 and 56 remain closed, however, when a dispensing valve 55 and/or 56 controls the relay 57, the carbonator 53 is filled regardless of its current water level. Upon the activation of a dispensing valve 55 and/or 56, the water pump delivers plain water at 140 psi. Consequently, the carbonator 53 fills because the plain water delivered at 140 psi overcomes the valve 54 so that the carbonator 53 receives plain water even though it may already contain a sufficient amount of water. As a result, the carbonator 53 overfills, which is a problem because, at a minimum, it alters the ratio of carbon dioxide and plain water, thereby ruining drink quality, and, at a maximum, it damages the carbonator 53 or potentially creates the dangerous situation where the carbonator 53 ruptures.

Accordingly, an apparatus and method that eliminates carbonator overfill during the delivery of plain water to dispensing valves will improve over currently available plain water pump controllers.

SUMMARY OF THE INVENTION

A pump control apparatus includes a pump coupled at an inlet to a water source and at an outlet to a first dispensing valve and a carbonator via a check valve. A power source is coupled to the pump, and a controller regulates the delivery of power from the power source to the pump. Responsive to a fill signal received from the carbonator, the controller activates the power source to deliver power to the pump at a first predetermined power level. Alternatively, the controller activates the power source to deliver power to the pump at a second predetermined power level in response to a dispense signal received from the first dispensing valve.

The outlet of the pump is further coupled to a second dispensing valve, and, responsive to a dispense signal received from the second dispensing valve, the controller activates the power source to deliver power to the pump at the second predetermined power level. Alternatively, the controller activates the power source to deliver power to the pump at a third predetermined power level in response to dispense signals received from both the first and second dispensing valves.

A method for controlling a pump includes coupling a power source to a pump and coupling the pump at an inlet to a water source and at an outlet to a first dispensing valve and a carbonator via a check valve. The carbonator is monitored for a carbonator fill signal, and, responsive to that fill signal, the power source is controlled to deliver power to the pump at a first predetermined power level. The first dispensing valve is monitored for a dispense signal, and, responsive to that dispense signal, the power source is controlled to deliver power to the pump at a second predetermined power level in response to the dispense signal.

The method further includes coupling the outlet of the pump to a second dispensing valve. The second dispensing valve is monitored for a dispense signal, and, responsive to that dispense signal, the power source is controlled to deliver power to the pump at the second predetermined power level. When dispense signals are received from both the first and second dispensing valves, the power source is controlled to deliver power to the pump at a third predetermined power level.

DETAILED DESCRIPTION OF THE PREFERRED EMBODIMENT

Figure 1:
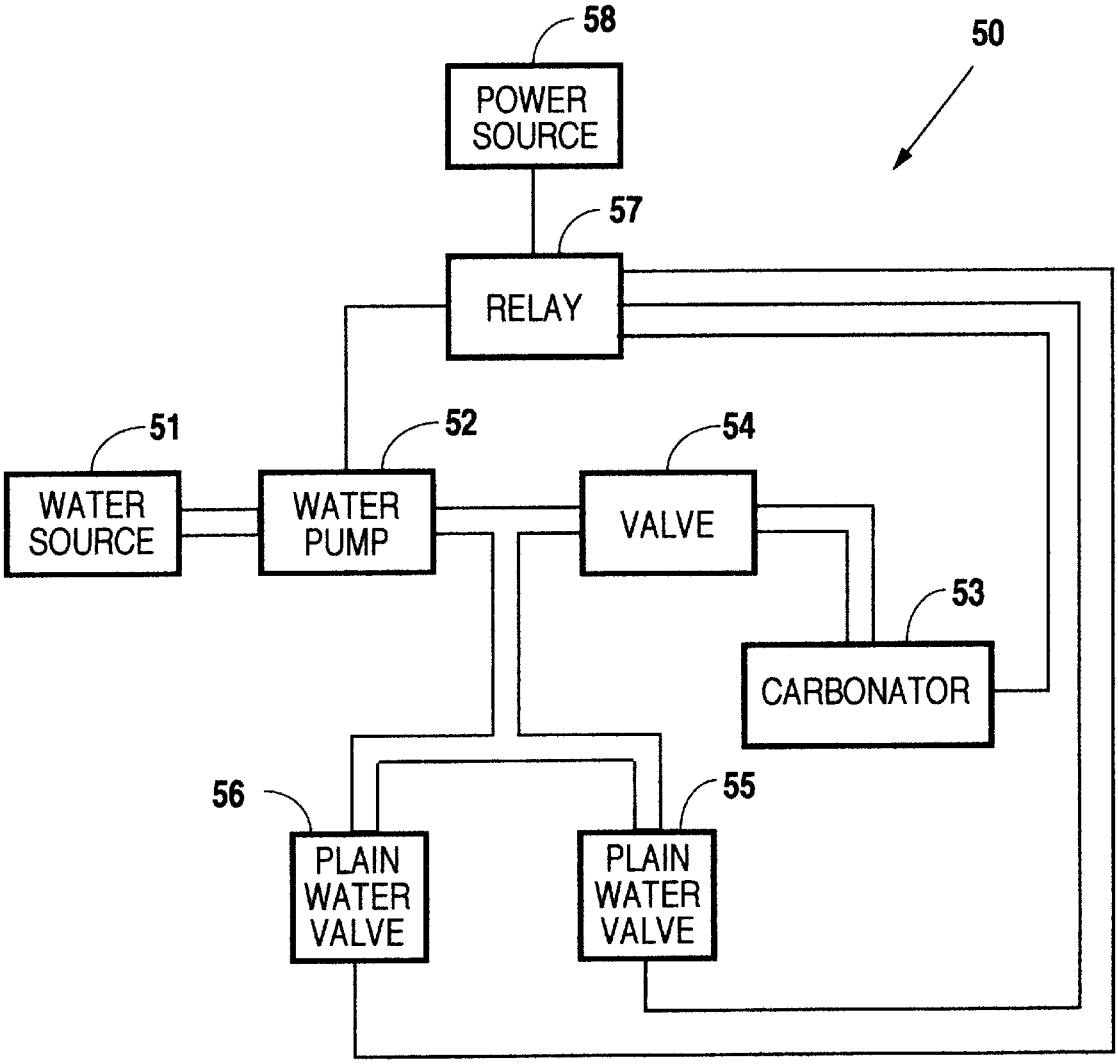
Fig. 1 (PRIOR ART)
FIG. 1 is a block diagram illustrating a prior art pump control apparatus.
Figure 2:
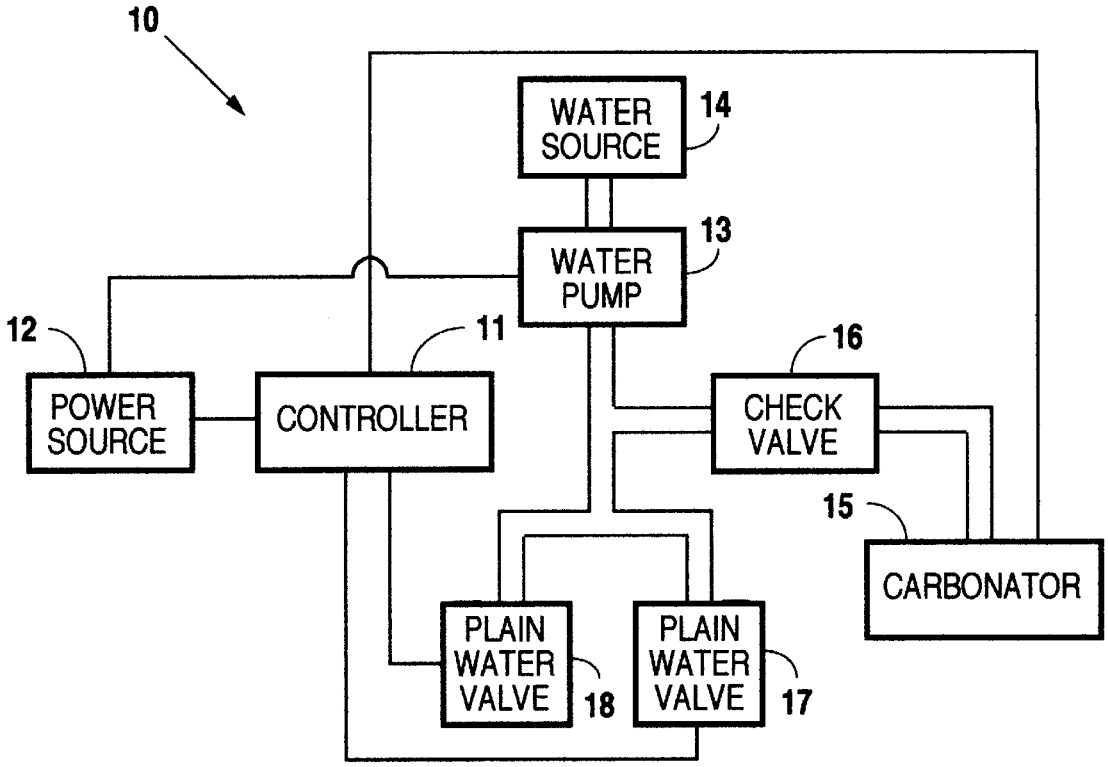
FIG. 2 is a block diagram illustrating a pump control apparatus according to the preferred embodiment.

As illustrated in FIG. 2, a pump control apparatus 10 includes a controller 11 that regulates the amount of power a power source 12 delivers to a water pump 13. The water pump 13 connects to a water source 14 to deliver plain water to a carbonator 15 via a valve 16 and to plain water valves 17 and 18. In this preferred embodiment, the water pump 13 is any standard water pump, such as a DC motor or an AC induction motor pump, while the water source 14 is a typical city public water line delivering water at less than 40 psi.

The carbonator 15 is a standard carbonator that entrains plain water contained therein with carbon dioxide gas to create carbonated water. The carbonator 15 includes a plain water level probe that connects to the controller 11 to provide the controller 11 with a signal indicating when the water pump 13 should be activated and deactivated. In this preferred embodiment, the valve 16 is a standard one-way check valve that opens at a 1 psi pressure differential beginning at 75 psi carbonator pressure.

The plain water valves 17 and 18 are standard dispensing valves that deliver plain water either alone or mixed with a syrup to produce a non-carbonated drink such as lemonade. The plain water valves 17 and 18 each include a switch that when closed delivers a signal to the controller 11 indicating the water pump 13 should be activated.

In this preferred embodiment, the controller 11 is any standard microprocessor or microcontroller that regulates the delivery of power from the power source 12. The power source 12 connects to a standard 110/120 VAC line and, in this preferred embodiment, is one of a DC voltage regulator including a switchable resistance relay controlled by the controller 11 to deliver variable power to the water pump 13, a DC voltage regulator pulse width modulated by the controller 11 to deliver variable power to the water pump 13, or an AC voltage regulator pulse width modulated by the controller 11 to deliver variable AC power to the water pump 13 which would be the AC induction motor pump. The switchable resistance relay includes an off position and three on positions that vary the amount of power the power source 12 delivers to the water pump 13.

Figure 3:
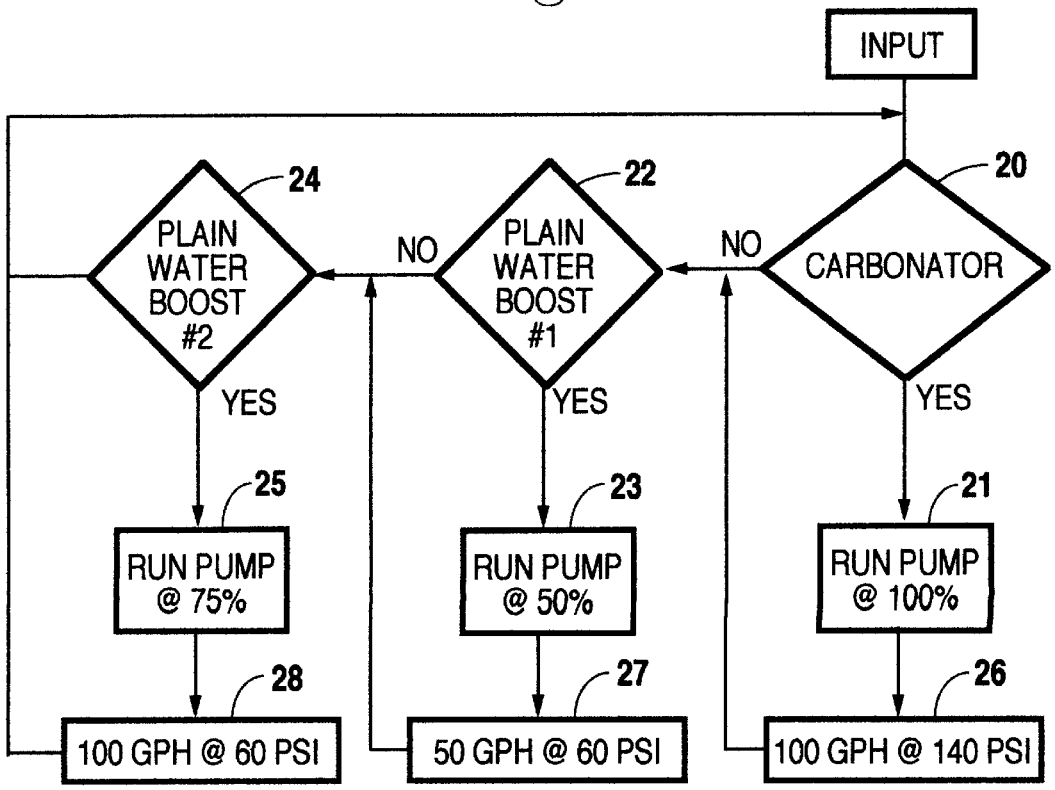
FIG. 3 is a flow chart illustrating the decision and control steps executed by the pump control apparatus of the preferred embodiment.

In operation as illustrated in FIG. 3, the controller 11 in step 20 checks to determine if the water level in the carbonator 15 is below the lower level limit. When the probe of the carbonator 15 outputs a signal indicating the water level is below the lower level limit, the controller 11 proceeds to step 21 and activates the power source 12 at a first predetermined power level (full power in this preferred embodiment). In the case of the switchable resistance relay, the controller 11 activates the relay to an on position that furnishes full power to the water pump 13. In the case of either DC or AC pulse width modulation, the controller 11 furnishes the power source 12 with a 100% duty cycle signal that facilitates the delivery of full power to the water pump 13. In step 26, the controller 11 maintains the water pump 13 at full power, thereby supplying the carbonator 15 at maximum flow capacity and designed outlet pressure via the valve 16 which has opened due to the pressure differential. After the carbonator 15 fills, its probe ceases outputting a signal to the controller 11 which deactivates the power source 12 thereby shutting off the water pump 13.

When the carbonator 15 does not require filling or its probe ceases outputting a signal, the controller 11 proceeds to step 22 and determines if one of the plain water valves 17 or 18 has been activated. If one of the plain water valves 17 or 18 has been activated, but not both, the controller 11 proceeds to step 23 and activates the power source 12 at a second predetermined power level (50% power in this preferred embodiment). In the case of the switchable resistance relay, the controller 11 activates the relay to an on position that furnishes 50% power to the water pump 13. In the case of either DC or AC pulse width modulation, the controller 11 furnishes the power source 12 with a 50% duty cycle signal that facilitates the delivery of 50% power to the water pump 13. In step 27, the controller 11 maintains the water pump 13 at 50% power, thereby supplying one of the plain water dispensing valves 17 or 18 at 50% flow capacity for designed outlet pressure (50 gph at 60 psi in this preferred embodiment). Upon the deactivation of the activated plain water dispensing valve 17 or 18, the controller 11 deactivates the power source 12 thereby shutting off the water pump 13. The water pump 13, therefore, delivers plain water to one of the plain water valves 17 or 18, however, the water pressure at 50% flow capacity is insufficient to open the valve 16, resulting in no filling of the carbonator 13 during the use of one of the plain water valves 17 or 18.

When the controller 11 does not detect the activation of only one of the plain water dispensing valves 17 or 18, it proceeds to step 24 and determines if both plain water valves 17 and 18 have been activated. If both the plain water valves 17 and 18 have been activated, the controller 11 proceeds to step 25 and activates the power source 12 at a third predetermined power level (75% power in this preferred embodiment). In the case of the switchable resistance relay, the controller 11 activates the relay to an on position that furnishes 75% power to the water pump 13. In the case of either DC or AC pulse width modulation, the controller 11 furnishes the power source 12 with a 75% duty cycle signal that facilitates the delivery of 75% power to the water pump 13. In step 28, the controller 11 maintains the water pump 13 at 75% power, thereby supplying both plain water dispensing valves 17 and 18 at flow capacity for designed outlet pressure (100 gph at 60 psi in this preferred embodiment). Upon the deactivation of the plain water dispensing valves 17 and 18, the controller 11 deactivates the power source 12 thereby shutting off the water pump 13. The water pump 13, therefore, delivers plain water to the plain water valves 17 and 18, however, the water pressure at 75% flow capacity is insufficient to open the valve 16, resulting in no filling of the carbonator 13 during the use of the plain water valves 17 and 18. Upon deactivation of the power source 12 or the failure to detect activation of both the plain water valves 17 and 18, the controller 11 returns to step 20 and continues monitoring the carbonator 15 and the plain water valves 17 and 18. It should be understood by those of ordinary skill in the art that the 50%, 75%, and 100% power levels are provided as an example and that power to the water pump 13 may be varied from 1%–100% as necessary to provide water at sufficient pressure for the operation of the carbonator 15 or plain water valves 17 and/or 18.

Although the present invention has been described in term of the foregoing preferred embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing description, rather, it is defined only by the claims that follow.

We claim:

1. A pump control apparatus, comprising:

a pump coupled at an inlet to a water source and at an outlet to a first dispensing valve and a carbonator via a check valve;

a power source coupled to the pump; and a controller for regulating power delivery from the power source wherein the controller activates the power source to deliver power to the pump at a first predetermined power level in response to a fill signal received from the carbonator and at a second predetermined power level different from the first predetermined power level in response to a dispense signal received from the first dispensing valve.

2. The pump control apparatus according to claim 1 wherein the outlet of the pump is coupled to a second dispensing valve.

3. The pump control apparatus according to claim 2 wherein the controller activates the power source to deliver power to the pump at the second predetermined power level in response to a dispense signal received from the second dispensing valve.

4. The pump control apparatus according to claim 2 wherein the controller activates the power source to deliver power to the pump at a third predetermined power level in response to dispense signals received from both the first and second dispensing valves.

5. A method for controlling a pump, comprising the steps of:

coupling a pump at an inlet to a water source and at an outlet to a first dispensing valve and a carbonator via a check valve;

coupling a power source to the pump;

monitoring the carbonator for a carbonator fill signal;

monitoring the first dispensing valve for a dispense signal;

controlling the power source to deliver power to the pump at a first predetermined power level in response to the carbonator fill signal; and controlling the power source to deliver power to the pump at a second predetermined power level different from the first predetermined power level in response to the dispense signal.

6. The method according to claim 5 further comprising the step of coupling the outlet of the pump to a second dispensing valve.

7. The method according to claim 6 further comprising the step of controlling the power source to deliver power to the pump at the second predetermined power level in response to a dispense signal received from the second dispensing valve.

8. The method according to claim 6 further comprising the step of controlling the power source to deliver power at a third predetermined power level in response to dispense signals received from both the first and second dispensing valves.

* * * * *